US008756838B2

(12) United States Patent
Muramoto et al.

(10) Patent No.: US 8,756,838 B2
(45) Date of Patent: Jun. 24, 2014

(54) VALVE MOUNTING STRUCTURE FOR A LOADER WORK VEHICLE, AND A LOADER WORK VEHICLE

(71) Applicant: Kubota Corporation, Osaka (JP)

(72) Inventors: Naoya Muramoto, Sakai (JP); Shusaku Yamaguchi, Sakai (JP); Kosuke Oyama, Sakai (JP); Arinobu Ishida, Sakai (JP)

(73) Assignee: Kubota Corporation, Osaka (JP)

( * ) Notice: Subject to any disclaimer, the term of this patent is extended or adjusted under 35 U.S.C. 154(b) by 0 days.

(21) Appl. No.: 13/904,073

(22) Filed: May 29, 2013

(65) Prior Publication Data

US 2013/0309056 A1 Nov. 21, 2013

Related U.S. Application Data

(62) Division of application No. 11/854,869, filed on Sep. 13, 2007, now abandoned.

(30) Foreign Application Priority Data

Sep. 29, 2006 (JP) ..... 2006-266594

(51) Int. Cl.
*E01H 5/04* (2006.01)

(52) U.S. Cl.
USPC ..... 37/234

(58) Field of Classification Search
USPC ..... 37/234, 235, 236, 411, 442; 172/813
See application file for complete search history.

(56) References Cited

U.S. PATENT DOCUMENTS

| | | | | | |
|---|---|---|---|---|---|
| 3,536,216 | A * | 10/1970 | Granville et al. | 414/694 |
| 3,633,436 | A * | 1/1972 | Freiburger | 74/471 XY |
| 3,893,346 | A * | 7/1975 | Paul | 74/471 R |
| 4,085,812 | A * | 4/1978 | Robinson et al. | 180/6.48 |
| 4,372,729 | A * | 2/1983 | Buschbom et al. | 414/700 |
| 4,431,364 | A * | 2/1984 | Redenbarger et al. | 414/697 |
| 4,526,204 | A * | 7/1985 | Primdahl | 137/637 |
| 4,643,442 | A * | 2/1987 | Ohashi et al. | 280/461.1 |
| 4,736,647 | A * | 4/1988 | Shimoie et al. | 74/471 XY |
| 4,825,568 | A * | 5/1989 | Kawamura et al. | 37/442 |
| 4,966,518 | A * | 10/1990 | Kourogi et al. | 414/700 |
| 5,232,057 | A * | 8/1993 | Renard | 172/812 |
| 5,316,435 | A * | 5/1994 | Mozingo | 414/685 |
| 5,429,037 | A * | 7/1995 | Weber et al. | 91/522 |
| 5,479,845 | A * | 1/1996 | Kawamura et al. | 91/514 |
| 5,553,992 | A * | 9/1996 | Ashcroft | 414/685 |
| 6,530,741 | B1 * | 3/2003 | Kourogi et al. | 414/686 |
| 6,637,136 | B2 * | 10/2003 | Aoki et al. | 37/468 |
| 7,036,248 | B2 * | 5/2006 | Meyeres et al. | 37/348 |
| 7,337,563 | B2 * | 3/2008 | Miyazaki | 37/234 |
| 7,617,620 | B2 * | 11/2009 | Fukudome et al. | 37/442 |
| 2003/0010196 | A1 * | 1/2003 | Smith et al. | 91/536 |
| 2008/0016976 | A1 * | 1/2008 | Fukudome et al. | 74/471 XY |
| 2008/0238153 | A1 * | 10/2008 | Nishino | 296/208 |

* cited by examiner

*Primary Examiner* — Matthew D Troutman
(74) *Attorney, Agent, or Firm* — The Webb Law Firm

(57) ABSTRACT

A front loader 3 is connected to a front portion of a tractor 1 having a tractor body. The front loader 3 includes mounting frames 7 arranged at right and left sides of the tractor body, booms 8 pivotally supported by upper ends of the mounting frames 7 to be vertically swingable, and a working implement 9 swingably connected to distal ends of the booms 8. A control valve 45 is disposed outside the tractor body 2 and rearwardly of one of the mounting frames 7 for controlling hydraulic cylinders 17, 29.

2 Claims, 6 Drawing Sheets

VALVE MOUNTING STRUCTURE FOR A LOADER WORK VEHICLE, AND A LOADER WORK VEHICLE

CROSS REFERENCE TO RELATED APPLICATIONS

This application is a divisional of and claims priority to co-pending U.S. patent application Ser. No. 11/854,869, filed Sep. 13, 2007, which claims priority to Japanese Patent Application No. 2006-266594 filed Sep. 29, 2006.

TECHNICAL FIELD

This invention relates to a valve mounting structure for a loader work vehicle having a front loader attached to the front of a tractor, and to the loader work vehicle.

BACKGROUND ART

A loader work vehicle has a front loader attached to the front of a tractor. The front loader has mounting frames provided at right and left sides of a tractor body, booms vertically swingably connected to upper portions of the mounting frames, a working implement such as a bucket swingably connected to distal ends of the booms, boom cylinders for swinging the booms, and an implement cylinder for swinging the working implement. Each of the right and left mounting frames has a support base protrude laterally outward of the tractor body, a main frame attached to a laterally outward end of the support base to project upward, and a side frame detachably attached to the main frame to project upward. Each boom has a proximal end thereof vertically swingably attached to an upper end of the side frame.

The conventional loader working vehicle of this type includes a control valve disposed outside or in an upper position of the main frames of the mounting frame for controlling the hydraulic cylinders of the front loader (JP2001-140276A, JP10-280473A, JP10-280464A and JP7-207701A).

DISCLOSURE OF THE INVENTION

Problem to be Solved by the Invention

Conventionally, there has been a possibility of the control valve obstructing the field of view, or certain obstacles interfering with the control valve in time of operation.

Having regard to the above drawback, this invention intends to provide an improvement to eliminate the possibility of the control valve obstructing the field of view, or certain obstacles interfering with the control valve in time of operation.

Means for Solving the Problem

In a structure for attaching a control valve to a loader work vehicle, according to this invention, a front loader is connected to a front portion of a tractor having a tractor body, the front loader including mounting frames arranged at right and left sides of the tractor body, booms pivotally supported by upper ends of the mounting frames to be vertically swingable, and a working implement swingably connected to distal ends of the booms, the control valve being disposed outside the tractor body and rearwardly of one of the mounting frames for controlling hydraulic cylinders.

According to the above construction, the control valve is effectively protected by being sandwiched fore and aft between the rigid mounting frame and fuel tank. The control valve is reliably guarded against interference from obstacles and the like. Since the control valve is disposed laterally of the tractor body, there is no possibility of the control valve obstructing the field of view in time of operation. Further, with the control valve disposed rearwardly of the mounting frame, the mounting frame may be used also as a guard for valve hoses.

In the above construction, it is preferred that a valve stay is disposed rearwardly of the one of the mounting frames and projecting laterally outward, and the control valve is attached to the valve stay.

It is also preferred that a valve cover is provided for covering at least areas laterally outward of and below the control valve, and control wires are provided in a plurality corresponding to the spools of the control valve, the plurality of control wires being arranged at vertical intervals laterally outward of the fuel tank to extend in the fore and aft direction, and arranged laterally inward of a side wall of the valve cover, and passed fore and aft through and held by a laterally outward portion of the valve stay.

In the above construction, it is preferred that each of the right and left mounting frames includes a support base projecting laterally outward from the tractor body, a main frame attached to a laterally outward end of the support base to project upward, and a side frame detachably attached to the main frame to project upward, one of the booms being pivotally supported at a proximal end thereof by an upper end of the side frame to be vertically swingable; and a laterally inward end of the support base is fixed to a connecting frame connected to a front axle frame of the tractor body, the support base projecting laterally outward from the connecting frame, the valve stay projecting laterally outward from a position of the connecting frame rearward of the support base, the control valve being disposed rearwardly of the support base and a lower portion of the main frame.

Preferably, the control valve has a plurality of spools corresponding to the hydraulic cylinders of the front loader; the plurality of spools being arranged vertically and projecting laterally outward from positions vertically spaced apart of a valve body, the control valve being attached to the valve stay such that a direction of thickness of the control valve coincides with a fore and aft direction.

A loader work vehicle according to this invention comprises:

a tractor having a tractor body; and a front loader connected to a front portion of the tractor;

the front loader including mounting frames arranged at right and left sides of the tractor body, booms pivotally supported by upper ends of the mounting frames to be vertically swingable, and a working implement swingably connected to distal ends of the booms;

wherein a tank is disposed outside the tractor body and rearwardly of one of the mounting frames, and a control valve is disposed outside the tractor body and rearwardly of the one of the mounting frames for controlling hydraulic cylinders of the front loader.

According to this invention, the control valve is effectively protected by being sandwiched fore and aft between the rigid mounting frame and fuel tank. The control valve is reliably guarded against interference from obstacles and the like. Since the control valve is disposed laterally of the tractor body, there is no possibility of the control valve obstructing the field of view in time of operation. Further, with the control valve disposed rearwardly of the mounting frame, the mounting frame may be used also as a guard for valve hoses.

In the above construction, it is preferred that a valve stay is disposed between the tank and the one of the mounting frames and projecting laterally outward, the control valve being attached to the valve stay.

The above construction may further comprise control wires for operating the control valve, the control wires being passed in a fore and aft direction through and held by the valve stay, and connected to spools of the control valve.

The above construction may further comprise a valve cover for covering at least areas laterally outward of and below the control valve, the control wires being provided in a plurality corresponding to the spools of the control valve, the plurality of control wires being arranged at vertical intervals laterally outward of the fuel tank to extend in the fore and aft direction, and arranged laterally inward of a side wall of the valve cover, and passed fore and aft through and held by a laterally outward portion of the valve stay.

It is preferred that, in the above construction, the tractor body has connecting frames connected to a front axle frame; each of the right and left mounting frames includes a support base projecting laterally outward from the tractor body, a main frame attached to a laterally outward end of the support base to project upward, and a side frame detachably attached to the main frame to project upward, one of the booms being pivotally supported at a proximal end thereof by an upper end of the side frame to be vertically swingable; and a laterally inward end of the support base is fixed to one of the connecting frames, the support base projecting laterally outward from the connecting frame, the valve stay projecting laterally outward from a position of the connecting frame rearward of the support base, the control valve being disposed rearwardly of the support base and a lower portion of the main frame.

It is also preferred that the control valve has a plurality of spools corresponding to the hydraulic cylinders of the front loader; and the control valve is disposed in vertical posture to have the plurality of spools arranged vertically and projecting laterally outward from positions vertically spaced apart of a valve body, the control valve being attached to the valve stay such that a direction of thickness of the control valve coincides with a fore and aft direction.

DETAILED DESCRIPTION OF THE INVENTION

An embodiment of this invention will be described hereinafter with reference to the drawings.

FIGS. 1 through 3 show a tractor mounted loader embodying this invention. In FIGS. 1 through 3, a tractor 1 has a front loader 3 attached to the front thereof.

The tractor 1 has a tractor body 2, a pair of right and left front wheels 4 and a pair of right and left rear wheels 5, A hood 6 is disposed on a forward portion for covering an engine, a radiator and so on.

The front loader 3 includes, as main components thereof, a pair of right and left mounting frames 7, a pair of right and left booms 8, and a working implement 9 such as a bucket.

Each of the right and left mounting frames 7 includes a cylindrical support base 10 projecting laterally outward from the tractor body 2, a main frame 11 attached to a laterally outward end of the support base 10 to project upward, and a side frame 12 detachably attached to the main frame 11 to project upward. These components are arranged at right and left sides of the tractor body 2. The booms 8 are pivotally supported at proximal ends thereof by upper ends of the side frames 12 to be vertically swingable relative thereto.

The tractor body 2 has connecting frames 2C connected to front axle frame 2A. The connecting frames 2C connect the front axle frame 2A and a flywheel housing, not shown, in the fore and aft direction.

The connecting frames 2C are arranged right and left, each in the form of a plate. Each connecting frame 2C has a front half fixed to a side surface of a rear half portion of the front axle frame 2A by a plurality of bolts, and a rear half fixed to a side surface of the flywheel housing by a plurality of bolts. The engine (not shown) is connected to the front of the flywheel housing, and a clutch housing, a transmission case 13 and a rear wheel differential are connected in series rearwardly of the flywheel housing.

The cylindrical support bases 10 are formed of metal pipes such as cylindrical steel pipes. The support bases 10 have inward ends thereof, transversely of the tractor body 2, inserted into circular bores formed in rearward regions of the connecting frames 2C, and fixed welded around the circular bores. Thus, the laterally outward ends of the support bases 10 project laterally outward of the tractor body 2. The main frames 11 are attached to the laterally outward ends of the support bases 10 to project upward. For this purpose, circular bores are formed in lower end regions of the main frames 11, and the laterally outward ends of the support bases 10 are inserted into the circular bores and fixed welded around these bores.

Each main frame 11 has a cylindrical boss 15 formed integral with an upper end portion thereof and having a pin hole extending sideways, and a receiver 16 formed integral with a front portion of a vertically intermediate region and having an arcuate receiving recess opening upward. Each main frame 11 is in the form of a single plate (thick board) of steel casting, and has a plurality of reinforcing ribs formed to extend vertically and fore and aft to form a crisscross pattern on both plate surfaces (or one plate surface). Recesses are formed between the reinforcing ribs to reduce weight.

The above main frames 11 are attached to opposite sides of the tractor 1 through the support bases 10 and connecting frames 2C in order to connect the side frames 12 of the front loader 3 to the front of the tractor 1 to be detachable therefrom.

The side frames 12 are disposed at the rear ends of booms 8 of front loader 3 in order to connect the front loader 3 to the front of the tractor 1 to be detachable therefrom, by using the main frames 11.

For this purpose, each side frame 12 includes an engaging pin 18 fixed to the lower end thereof for engaging the receiver 16 of the corresponding main frame 11. Further, each side frame 12 includes a cylindrical boss 19 formed integral with a rear portion of a vertically intermediate region thereof and having a pin bore corresponding to the boss 15 of the main frame 11.

The front loader 3 can be connected to the tractor 1 by engaging the engaging pins 18 of the side frames 12 with the receivers 16 of the main frames 11, then aligning the bosses 15 and 19, and inserting linking pins 21 therethrough. The front loader 3 can is separable from the tractor 1 by removing the linking pins 21.

The booms 8 are bent in a longitudinally middle position thereof to form an arched, angular shape, and have a vertical width gradually enlarging from the front and rear ends to the longitudinally middle position. Each boom 8 is wholly formed of a metal plate such as steel plate to have a shape of substantially square pipe. The booms 8 are arranged to form a right and left pair at opposite sides of the hood 6. The pair of booms 8 are interconnected in front regions thereof by a connecting pipe 23.

The booms 8 are pivotally connected at proximal ends (rear ends) thereof to the upper ends of the side frames 12 by pins 22 to be vertically swingable about a transverse axis.

A boom cylinder 17 consisting of a double acting hydraulic cylinder extends between a longitudinally intermediate position of each boom 8 and a vertically intermediate position of each side frame 12. The booms 8 are swingable by extension and contraction of the right and left boom cylinders 17.

The distal ends (forward ends) of the booms 1 are pivotally connected by pins 24 to lower positions on the back of the working implement 9. Opposite ends of a two-piece flexion link 25 are connected by pins 26 and 27 to the back of the working implement 9 and a position adjacent the forward end of each boom 8. An implement cylinder (bucket cylinder) 29 consisting of a double acting hydraulic cylinder extends between an upper surface in a longitudinally intermediate position of each boom 8 and an intermediate connection point of the two-piece flexion link 25. The working implement 9 is swingable (for scooping and dumping action) by extension and contraction of the implement cylinder 29.

A stand 33 is attached to lower surfaces of forward regions of the booms 8. This stand 33 is used for supporting and self-sustaining the booms 8 with the working implement 9 resting on the ground when the front loader 3 is separated from the tractor 1. When the front loader 3 is connected to the tractor 1, the stand 33 may be contained in a position along the lower surface of the forward regions of the booms 8.

The tractor body 2 has rear wheel fenders 35 arranged at opposite sides of a rear portion thereof for covering inner sides of the rear wheels 5, respectively. A driver's seat 36 is disposed between the right and left rear wheel fenders 35. A driving section 39 including a steering wheel 37 is provided forwardly of the driver's seat 36. A four-strut type rollover protection structure 40 is erected on the tractor body 2 to surround the driver's seat 36 and driving section 39.

As shown also in FIGS. 4 through 6, a fuel tank 43 is disposed outside the tractor body 2 and rearwardly of one of the mounting frames (right-hand frame) 7. A control valve 45 is disposed outside the tractor body 2 and between this mounting frame 7 and fuel tank 43 for controlling the hydraulic cylinders (boom cylinders 17 and implement cylinders 29) of the front loader 3.

In FIGS. 4 through 6, a valve stay 51 projects laterally outward from between the fuel tank 43 outside the tractor body 2 and the mounting frame 7. The valve stay 51 is formed of a plate. The valve stay 51 has a laterally inward portion thereof fixed by a fixing device 53 such as bolts and nuts to a mounting piece 52 projecting from the connecting frame 2C. Thus, the valve stay 51 projects from the connecting frame 2C to separate the fuel tank 43 and mounting frames 7 from each other in the fore and aft direction. The control valve 45 is attached by a fastening device such as bolts and nuts to the front surface of the valve stay 51. Thus, the valve stay 51 projects laterally outward from a position rearward of the support base 10 of the connecting frame 2C, and the control valve 45 is disposed rearwardly of the support base 10 and a lower portion of the main frame 11.

The control valve 45 has a plurality of (three in the illustrated example) spools 57 corresponding to the hydraulic cylinders (boom cylinders 17, implement cylinders 29 and so on) of the front loader 3. The control valve 45 is connected to the boom cylinders 17, implement cylinders 29 and so on through valve hoses 46. By push/pull operation of the spools 57, pressure oil may be supplied selectively or simultaneously to the boom cylinders 17 and implement cylinders 29. The control valve 45 has the plurality of spools 57 arranged vertically and projecting laterally outward from positions vertically spaced apart of a valve body. The control valve 45 is attached to the valve stay 51 such that the direction of thickness of the control valve 45 coincides with the fore and aft direction. The control valve 45 has larger vertical and sideways dimensions than a fore and aft dimension.

In this embodiment, the control valve 45 has three spools 57. One of the three spools 57 serves to feed pressure oil to the boom cylinders 17. Another serves to feed pressure oil to the implement cylinders 29. The remaining one is used when, for example, a different working implement is provided instead of or in addition to the working implement (bucket) 9, and serves to feed pressure oil to a spare or auxiliary hydraulic cylinder, not shown, for actuating the different working implement.

A valve cover 59 is disposed laterally outward of the tractor body 2 for covering at least areas laterally outward of and below the control valve 45. This valve cover 59 has a front wall 61 for closing the front of the control valve 45, a side wall 62 for closing an outer lateral side of the control valve 45, and a bottom wall 63 for closing a lower part of the control valve 45. Thus, the valve cover 59 is in the form of a rectangular box opening upward rearward and laterally inward. The valve cover 59 is fixed by a fixing device 60 such as bolts and nuts to a mounting piece 58 projecting forward from an outward end of the valve stay 51. Thus, the valve cover 59 is attached to an outer lateral position of the tractor body 2 through the valve stay 51.

The side wall 62 and front wall 61 of the valve cover 59 are formed by bending a piece of sheet metal at a right angle. A front slope portion 65 inclined rearward and downward is formed at the lower end of the front wall 61. An outer side slope portion 66 inclined inward and downward is formed at the lower end of the side wall 62. The bottom wall 63 is formed of a piece of sheet metal separate from the front wall 61 and side wall 62, and is fixed such as by welding to the front slope portion 65 of the front wall 61 and the outer side slope portion 66 of the side wall 62. The front wall 61 has an upper lid piece 68 and a mounting piece 69 formed integral with and bent rearward from the upper end thereof.

The control valve 45 is operable by a plurality of (three) control wires 71 corresponding in number to the spools 57 of the control valve 45. The control wires 71 are arranged at vertical intervals laterally outward of the fuel tank 43 to extend in the fore and aft direction, arranged laterally inward of the side wall of the valve cover 59, and passed fore and aft through and held by a laterally outward portion of the valve stay 51. Forward ends of the control wires 71 are connected through links 72 to the spools 57 of the control valve 45.

Each control wire 71 is formed of a push-pull cable or Bowden cable having an inner wire 73 and an outer wire 75. The outer wire 75 of each control wire 71 is passed fore and aft through the laterally outward portion of the valve stay 51 and fixed to the valve stay 51 with nuts 77. The inner wire 73 extends through the outer wire 74 past the valve stay 51, so that the forward end of the inner wire 73 is connected to the spool 57 of the control valve 45 through the link 72. Each link 72 corresponding to each control wire 71 is supported by a link stay 78 to be pivotable about a vertical axis. By pulling the inner wire 73 of each control wire 71, the spool 57 is pulled to open the control valve 45. The spool 57 is pushed back by a spring force. The inner wires 73 of the control wires 71 are pushed and pulled selectively or simultaneously by operating control levers, not shown, arranged adjacent the driver's seat 36.

According to the above embodiment, the fuel tank 43 is disposed outside the tractor body 2 and rearwardly of one of the mounting frames 7. The control valve 45 is disposed outside the tractor body 2 and between one of the mounting frames 7 and the fuel tank 43 for controlling the hydraulic cylinders 17 and 29 of the front loader 3. Thus, the control valve 45 is effectively protected by being sandwiched fore and aft between the rigid mounting frame 7 and fuel tank 43. The control valve 45 is reliably guarded against interference from obstacles and the like. Since the control valve 45 is disposed laterally of the tractor body 2, there is no possibility of the control valve 45 obstructing the field of view in time of operation. Further, with the control valve 45 disposed rearwardly of the mounting frame 7 (main frame 11), the mounting frame 7 (main frame 11) may be used also as a guard for the valve hoses 46.

The valve stay 51 projects laterally outward from between the fuel tank 43 outside the tractor body 2 and the mounting frame 7. The control valve 45 is attached to the valve stay 51. The control wires 71 for operating the control valve 45 are passed in the fore and aft direction through and held by the valve stay 51, and connected to the spools 57 of the control valve 45. Thus, the control wires 71 for operating the control valve 45 can be fixed by using the valve stay 51 for attaching the control valve 45, This allows the control wires 71 to be arranged in proper positions corresponding to the spools 57, and can secure space for arranging and fixing the control wires 71.

The valve cover 59 is provided to cover at least areas laterally outward of and below the control valve 45. A plurality of control wires 71 are provided to correspond in number to the spools 57 of the control valve 45, The control wires 71 are arranged at vertical intervals laterally outward of the fuel tank 43 to extend in the fore and aft direction, and arranged laterally inward of the side wall of the valve cover 59, and passed fore and aft through and held by a laterally outward portion of the valve stay 51. Thus, the side wall of the valve cover 59 can effectively protect the plurality of control wires 71, and the control wires 71 can be arranged tidily.

Further, the control valve 45 has a plurality of spools 57 corresponding to the hydraulic cylinders 17 and 29 of the front loader 3. The control valve 45 is disposed in vertical posture to have the plurality of spools 57 arranged at vertical intervals and projecting laterally outward from the valve body. The control valve 45 is attached to the valve stay 51, to have the direction of thickness thereof coinciding with the fore and aft direction. By setting the control valve 45 to the vertical posture, the control valve 45 may be placed compactly between the fuel tank 43 and mounting frame 7 (main frame 11). In this way, effective use is made of the space laterally of the tractor body 2 between the fuel tank 43 and mounting frame 7.

In the above embodiment, the fuel tank 43 is disposed at the right side of the tractor body 2 and rearwardly of the right mounting frame 7. The control valve 45 is disposed at the right side of the tractor body 2 and between the right mounting frames 7 and the fuel tank 43. Instead, the oil tank and other tanks may be arranged rearwardly of the mounting frame 7, and the control valve 45 may disposed between the mounting frame 7, and the oil tank and other tanks. The fuel tank 43 may be disposed at the left side of the tractor body 2 and rearwardly of the left mounting frames 7, and the control valve 45 disposed at the left side of the tractor body 2 and between the left mounting frame 7 and the fuel tank 43.

In the above embodiment, the control valve 45 has three spools 57 corresponding to the hydraulic cylinders 17 and 29 of the front loader 3, and three control wires 71 for operating the control valve 45 are provided to correspond to the spools 57, The number of spools and control wires is not limited to this. The number of spools 57 and control wires 71 may be one or two each, or four or more, of course.

In the above embodiment, the valve cover 59 has a front wall 61 for closing the front of the control valve 45, a side wall 62 for closing an outer lateral side of the control valve 45, and a bottom wall 63 for closing a lower part of the control valve 45. Since the front and back of the control valve 45 can be protected by the tank 43 and mounting frame 7, the valve cover 59 may cover only the outer lateral side and lower part of the control valve 45. Thus, the valve cover 59 may have the side wall 62 and bottom wall 63, with the front wall 61 omitted. The front wall 61 may have a cutout in a portion thereof opposed to the main frame 11.

This invention is applicable to a loader work vehicle with a front loader attached to a tractor.

DESCRIPTION OF THE REFERENCES

Figure 1:
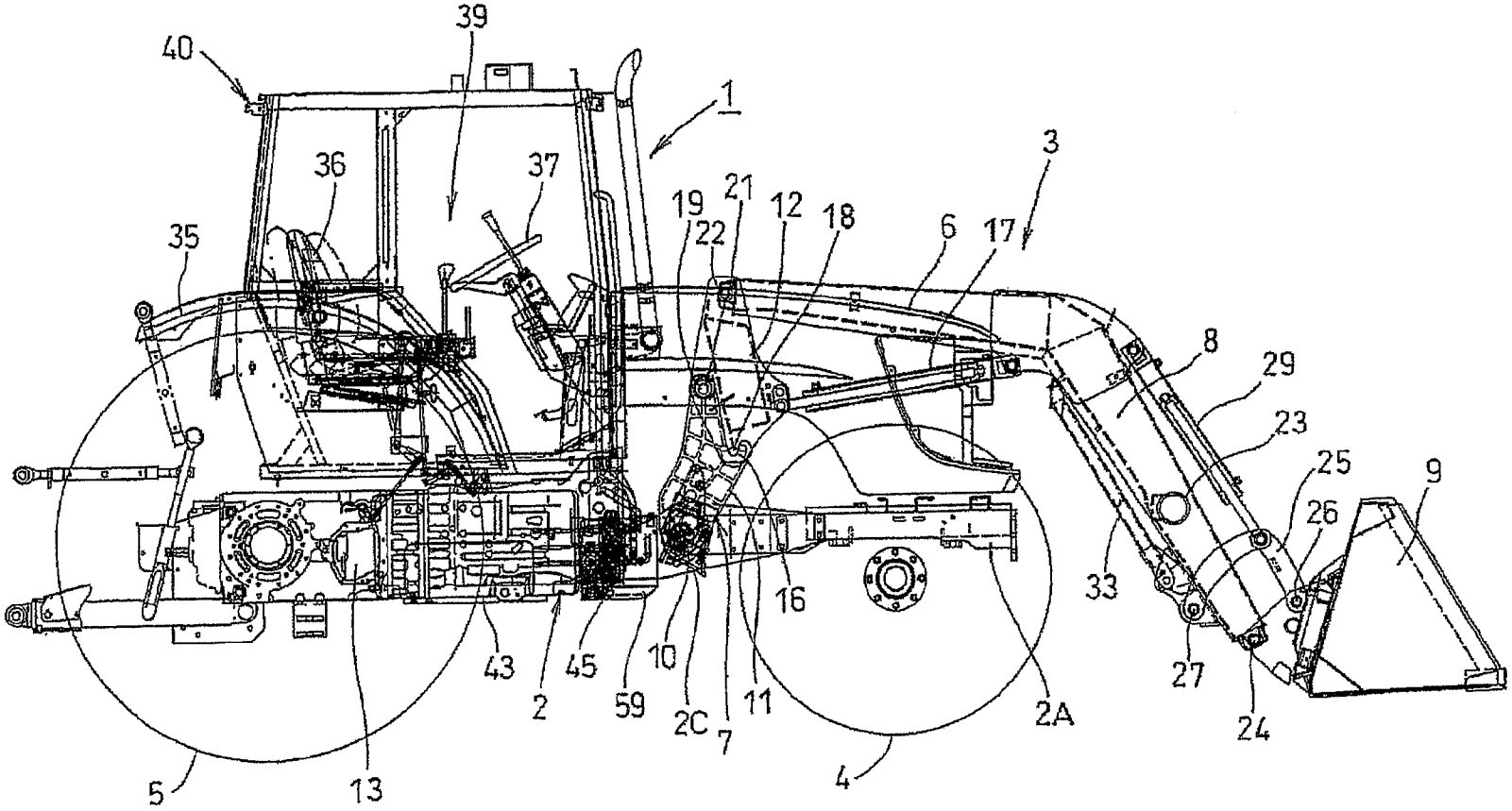
FIG. 1 Side view of a tractor-mounted loader in one embodiment of this invention FIG. 2 Plan view of the tractor-mounted loader FIG. 3 Front view of the tractor-mounted loader FIG. 4 Side view of a control valve mounting portion FIG. 5 Plan view of the control valve mounting portion FIG. 6 Front view of the control valve mounting portion
Figure 2:
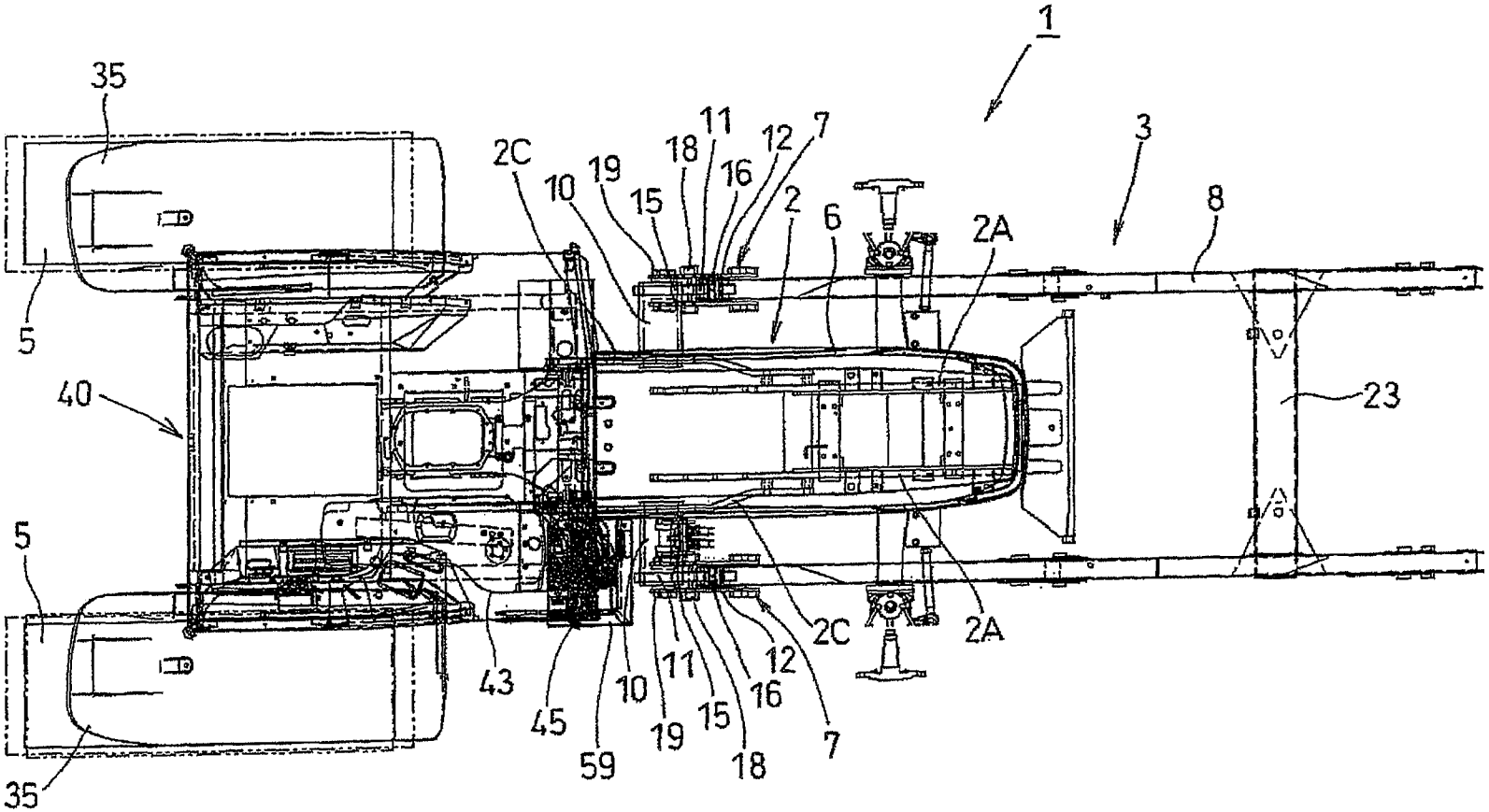
Figure 3:
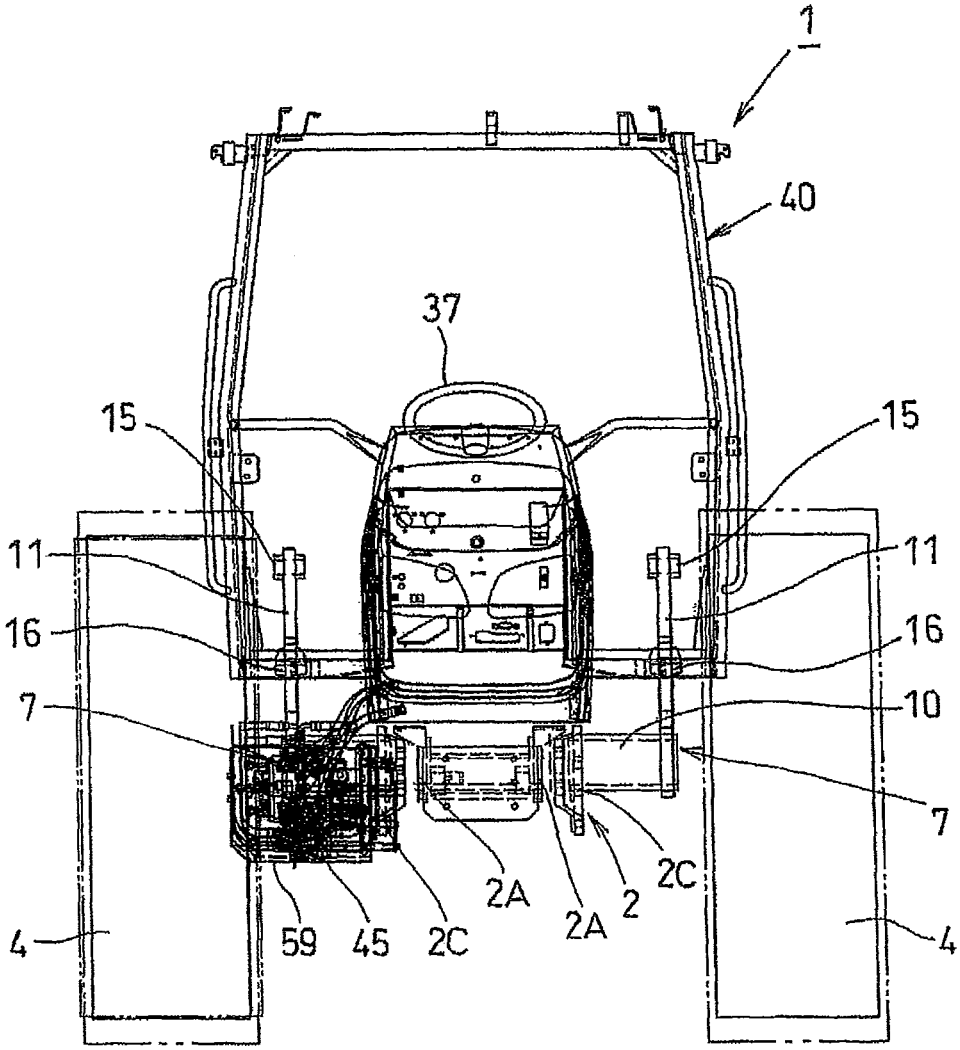
Figure 4:
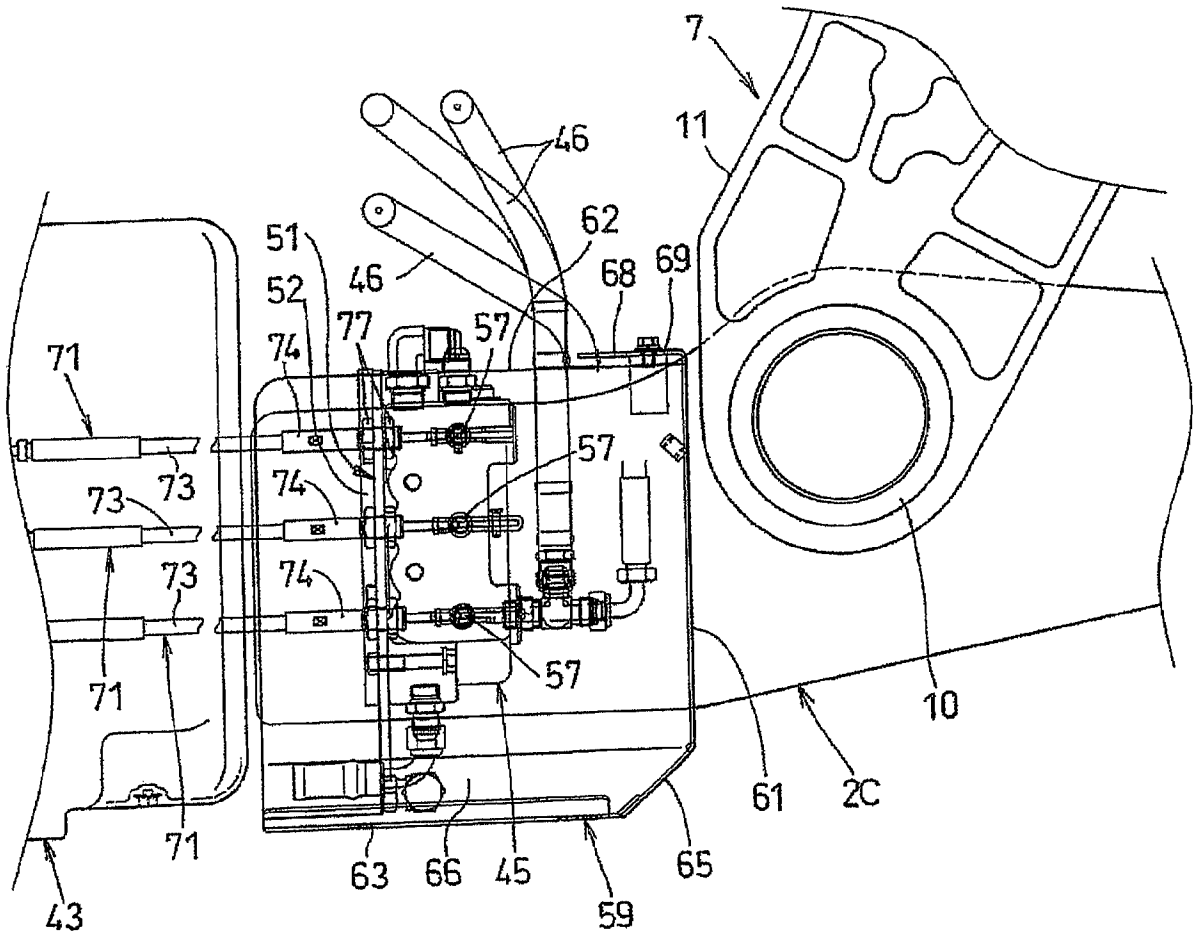
Figure 5:
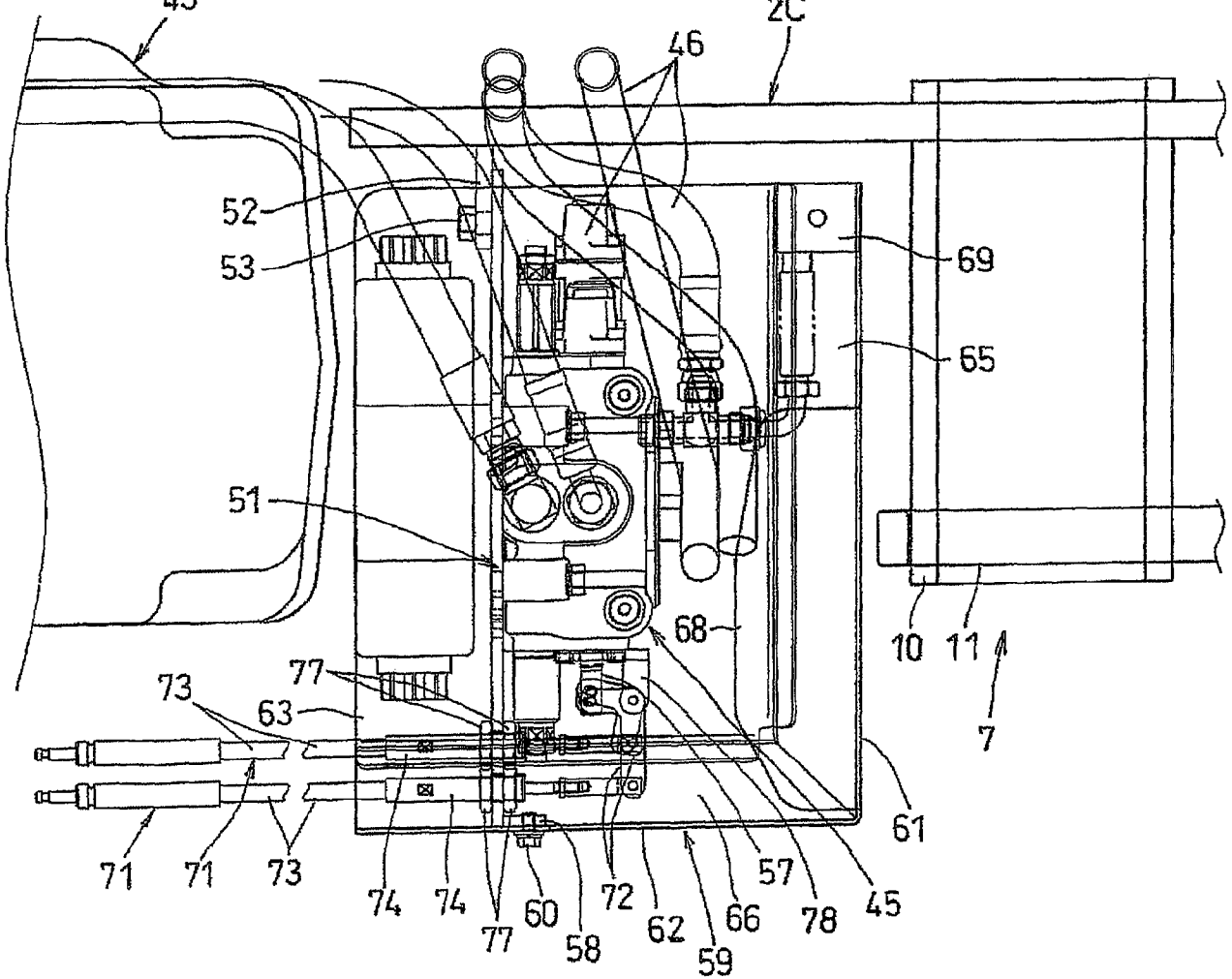
Figure 6:
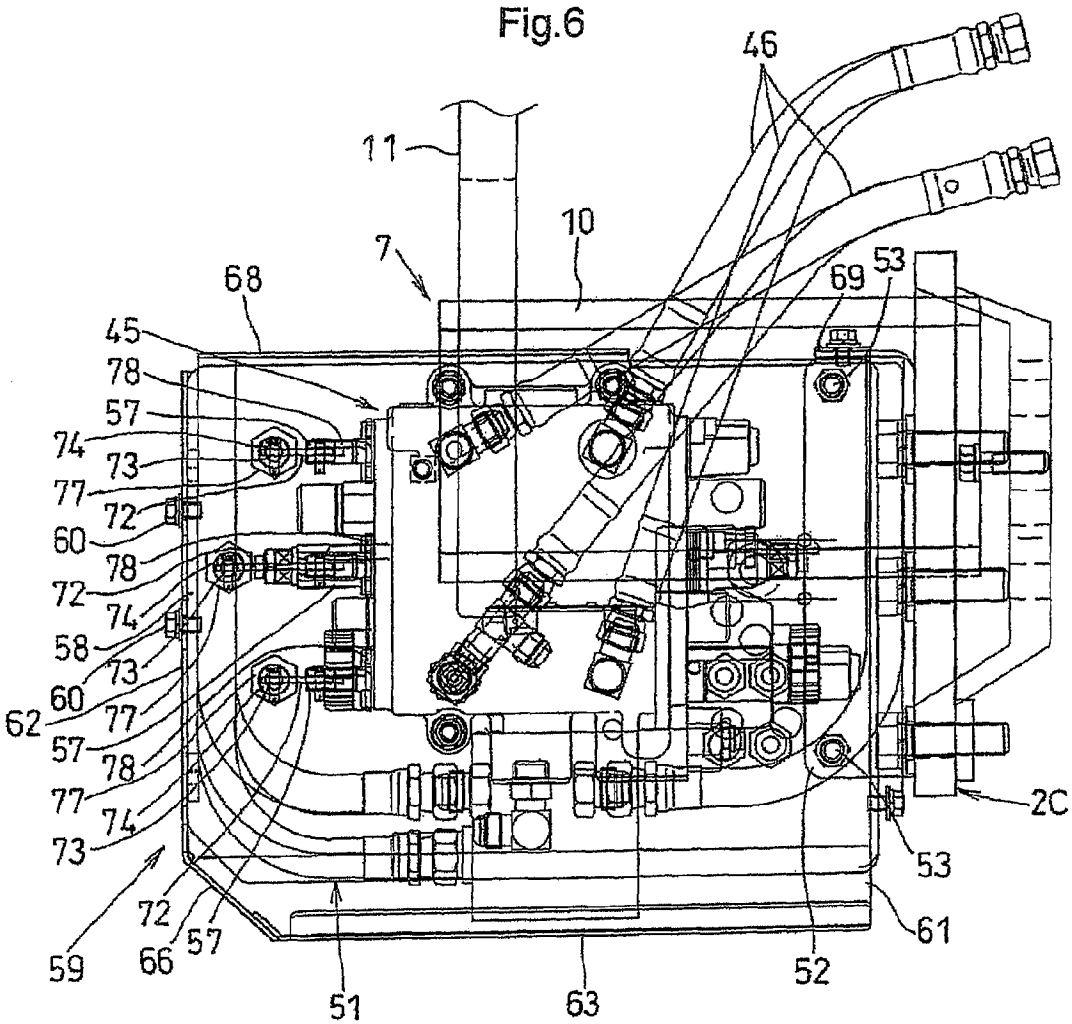

1 tractor
2 tractor body
3 front loader
7 mounting frames
8 booms
9 working implement (bucket)
10 support bases
11 main frames
12 side frames
17 boom cylinders
29 implement cylinders
43 fuel tank
45 control valve
51 valve stay
57 spools
59 valve cover
62 side wall
71 control wires
72 links

The invention claimed is:

1. A front loader adapted to be attached to a loader work vehicle having a fuel tank mounted thereon, said front loader being disposed forwardly of the fuel tank and connected to a front portion of a tractor having a tractor body in a fore and aft direction of the loader work vehicle, said tractor body having a pair of right and left connecting frames which are connected to a pair of right and left front axle frames, respectively, said front loader comprising:

mounting frames arranged at right and left sides of said tractor body and having support bases projected laterally outward respectively from said pair of right and left connecting frames;

booms pivotally supported by respective upper ends of the mounting frames to be vertically swingable;

a working implement swingably connected to respective distal ends of the booms; and a valve stay having a laterally inward portion secured to a mounting piece of the connecting frame associated therewith, wherein the valve stay is disposed rearwardly of the support bases and forwardly of the fuel tank in the fore and aft direction and projects from the connecting frame to separate the fuel tank and the support bases from each other in the fore and aft direction, and wherein the valve stay defines openings configured to receive and hold a plurality of control wires.

2. The front loader according to claim 1, wherein said valve stay is formed of a plate; and said mounting piece projects from the connecting frame associated therewith, with the laterally inward portion of the valve stay configured to be secured to the mounting piece.

* * * * *